US005103610A

United States Patent [19]

Walters

[11] Patent Number: 5,103,610

[45] Date of Patent: Apr. 14, 1992

[54] LOG BUILDING ELEMENT

[76] Inventor: Victor R. Walters, P.O. Box 250, Sechelt, B. C., Canada, V0N 3A0

[21] Appl. No.: 478,532

[22] Filed: Feb. 12, 1990

[51] Int. Cl.[5] ..... E04B 1/10

[52] U.S. Cl. ..... 52/233; 52/286; 52/595

[58] Field of Search ..... 52/233, 284, 286, 595

[56] References Cited

U.S. PATENT DOCUMENTS

| | | | |
|---|---|---|---|
| 2,416,162 | 2/1947 | Drake | 52/233 |
| 2,669,060 | 2/1954 | Kalvig | 52/233 X |
| 3,552,079 | 1/1971 | Mortensen | 52/593 |
| 3,908,322 | 9/1975 | Shoaf | 52/233 X |
| 4,287,694 | 9/1981 | Cornell | 52/233 |

FOREIGN PATENT DOCUMENTS 236132 11/1961 Australia .

*Primary Examiner*—David A. Scherbel
*Assistant Examiner*—Linda J. Watson

[57] ABSTRACT

A log structure may be built from interfitting squared logs, mounted with their diagonals vertically aligned, with the upper corner of each log fitted into a "V" shaped groove formed into the lower edge of each log. Intersecting log walls are interfitted by "V" shaped notches cut on the underside of each interjecting log. The depth of the "V" notch should not exceed half of the diagonal of each log by more than one half of the depth of the longitudinal groove.

7 Claims, 3 Drawing Sheets

LOG BUILDING ELEMENT

FIELD OF THE INVENTION

This invention relates to a building elements adapted to form a wall or structure out of logs. More particularly, this invention relates to a means of interfitting logs so as to form an integral wall.

BACKGROUND TO THE INVENTION

The construction of log structures by the method of notching logs so that they interfit with each other is well known. Logs have long been notched transversely near their ends so as to allow such logs to be interfitted at corners, thus allowing the longitudinal span of consecutive logs, on progressively elevated courses, to lie in closer proximity to each other. Logs have also been grooved longitudinally to allow logs resting directly on top of each other to be more closely interfitted.

In the case of transverse notches used in traditional log cabins having singularly notched logs laying over round logs, the notches have been shaped to a round profile. Such a single rounded notch generally has a depth of about one-half of the log diameter. When complementary notches in crossing logs have been employed, such notches have customarily been rectangular in cross-section. Notches in this case are about one-quarter of the log diameter in depth. An example of notching in this latter form is shown in U.S. Pat. No. 2,059,598 to N. J. Paulson. Triangular or "V" shaped notches adapted to allow intersecting courses of rectangular logs (oriented with their diagonals in the vertical plane) to be interfitted have also been proposed. An example in this latter category is U.S. Pat. No. 2,669,060 to Kalvig.

To allow logs to be interfitted longitudinally, use of an extended longitudinal tongue or tenon has been proposed. Such a tenon may be milled or fitted into a log along its length. This longitudinal tenon, positioned on the upper side of one course of logs, is arranged to interfit into a complementary longitudinal groove formed in the lower side of the next above course of logs. Such an arrangement is shown in U.S. Pat. No. 2,238,039 to De Witt.

The prior art does not show, however, an arrangement by which courses of logs of rectangular cross-section are longitudinally interfitted directly into each other without the necessity of forming a specially shaped tenon along the length of the individual logs.

This invention is directed to a means by which logs may be shaped so as to be so interfitted longitudinally, without the formation of a tenon by a supplementary operation, or by any operation other than the squaring of the log. These and other features of the invention will become apparent from the description of the invention which now follows.

SUMMARY OF THE INVENTION

The invention consists of a structure having walls which intersect at corners, such walls being formed from courses of logs of the same substantially rectangular overall cross-section, each of said logs being oriented with a diagonal lying in a vertical plane which is the vertical plane of the wall, said logs being further characterized by having a longitudinal groove running the length of the underside of each log, said longitudinal groove being composed of two flat longitudinal surfaces which intersect at a right angle and which are symmetrically disposed about the vertical plane of the wall, each of said logs being provided with a transverse "V" shaped notch at the corners of said structure whereby intersecting courses of logs are nested with said "V"-shaped notch fitted over the upper surfaces of a transverse log from the intersecting wall.

By an added feature of the invention the depth of the transverse "V"-shaped notch on a first log, laying over a transverse log at a corner, does not exceed one half of the length of the major diagonal of the transverse log by more than one half of the amount of the depth of the longitudinal groove in the first log, measured in the vertical plane.

By a further feature of the invention, the depth of said "V"-shaped notch is equal to one-half of the major diagonal of the next lower log upon which said "V"-shaped groove rests, plus one half of the depth of the longitudinal groove of said next lower log, measured in the vertical plane.

By a further preferred feature of the invention, the depth of said longitudinal groove does not exceed one half of the length of the major diagonal of each log.

By a further feature of the invention, the depth of the longitudinal groove is greater than one eighth, but less than one quarter of the length of the major diagonal of each log.

These and further features of the invention will become more apparent from the description of the preferred embodiments which now follow.

SUMMARY OF THE FIGURES

FIG. 5 *a,b* is a view of three logs intersecting at a corner wherein the depth of the transverse notch in the log shown in side view equals one half of the diagonal of the transverse log on which it rests plus one half of the depth of the longitudinal groove in such log.

In FIG. 1, a walled log structure is shown having intersecting walls 1,2 composed of logs 3. The logs meet at corners 4 where the log ends 5 are interleaved in the standard fashion.

Figure 1:
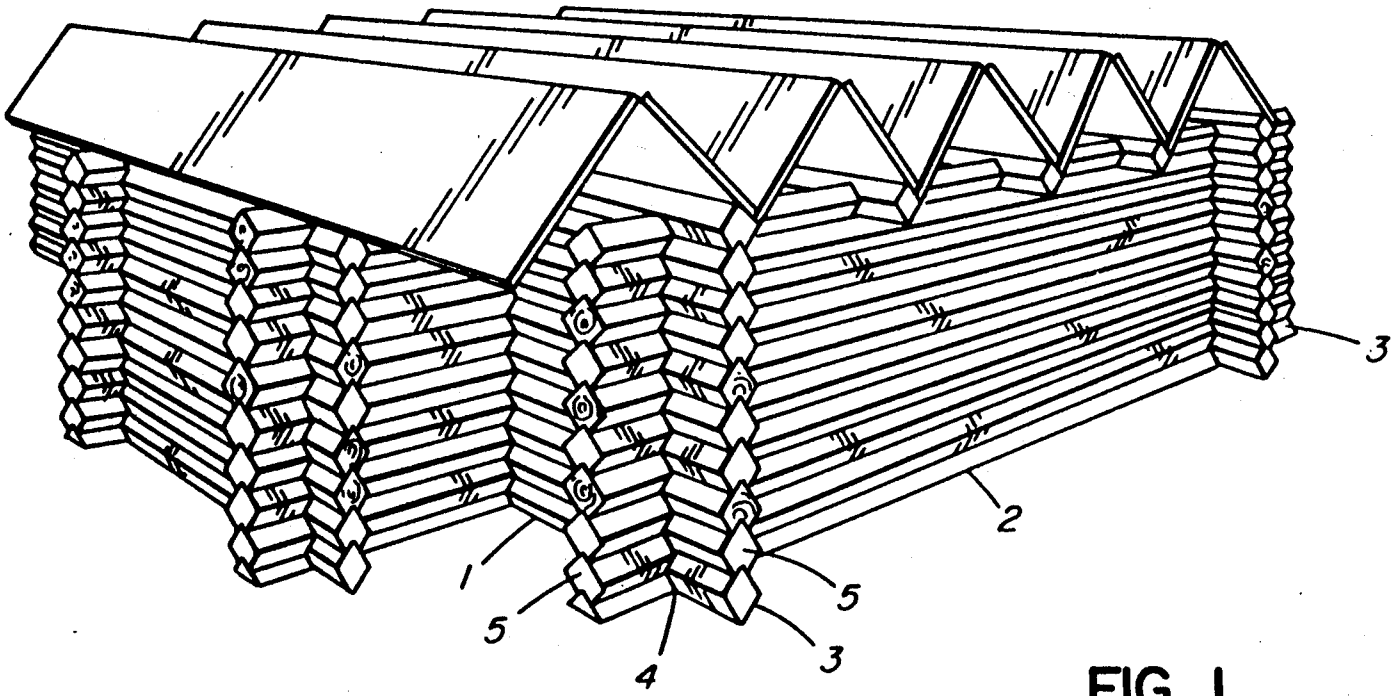
FIG. 1 is a perspective view of a structure constructed with logs made in accordance with the invention.
Figure 2:
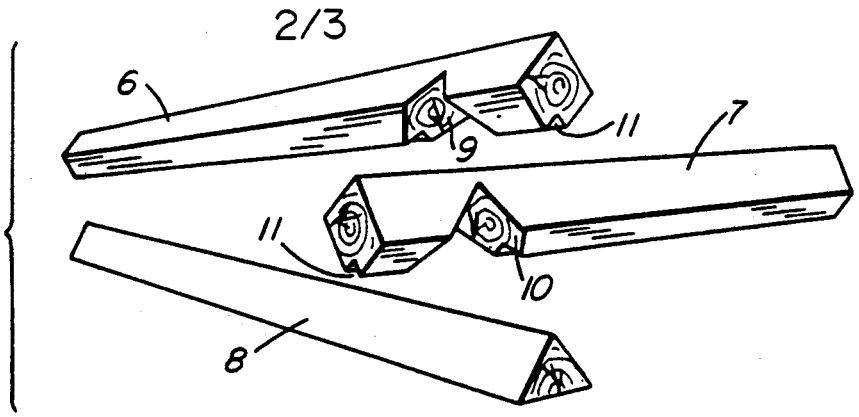
FIG. 2 is an exploded perspective view of two logs of the type of FIG. 1 as they intersect at a corner.

Details of this intersection are shown in FIG. 2 where a log 6 is shown overlying a log 7. The latter log 7 overlies a base half-log 8 which sits on the foundation (not shown). Cut into the logs 6,7 are transverse notches 9, 10 and longitudinal grooves 11.

Figure 3:
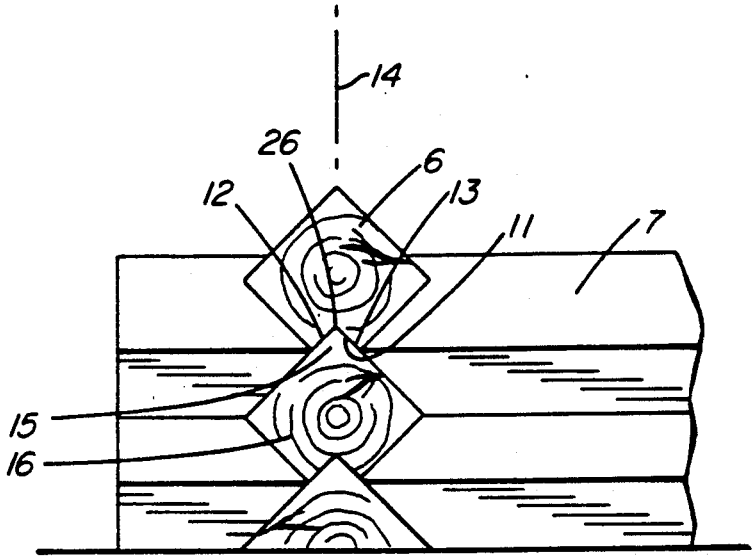
FIG. 3 is a face view of a wall corner with intersecting courses of logs interfitted between each other at their ends.

A longitudinal groove 11 cut into the lower side of a log 6 is shown in end view in FIG. 3. This groove 11 has two flat sides 12,13 that run the length of the log and are symmetrical about the central vertical plane 14 of the course of logs shown in end view. The sides 12,13 of the longitudinal groove 11 meet at 90 degrees, at an apex 26, giving the groove a profile into which the upper edge 15 of the next lower transverse log 16 will fit intimately.

Figure 4:
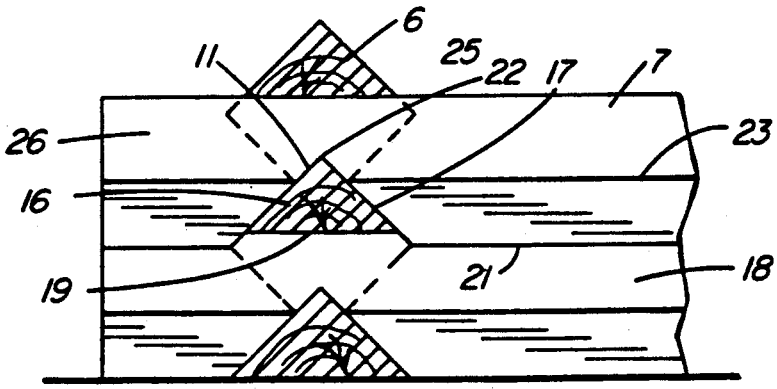
FIG. 4 is a cut-away cross-section of the corner of FIG. 3 in which the ends only of the transverse logs are shown in cross-section.

FIG. 4 shows the manner in which a transverse notch 17 is cut into a log 7 in order to permit it to fit over the transverse log 16 with an intimate engagement. In this cut-away view, the upper edge 19 of the next lower log 18 is elevated above the shoulder 21 of the groove (not shown) in the next log 7 above.

The upper corner 22 of the transverse notch 17 will be seen in FIG. 4 to be located above the median edge 23 of the log 7. As the notch 17 is made deeper, the longitudinal groove 11 in the upper transverse log 6 must be made wider to assure an intimate fit between the logs 6 and 16. A wider engagement between these logs is desirable to improve the weather tightness of the wall, and its insulative capacity.

Figure 5A:
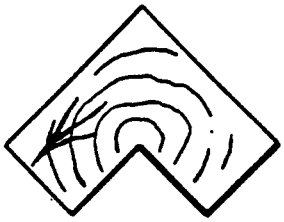
FIG. 5*b* is a face view of the intersecting logs and FIG. 5*a* is an end view of the log shown in side view of FIG. 5*b*.
Figure 5B:
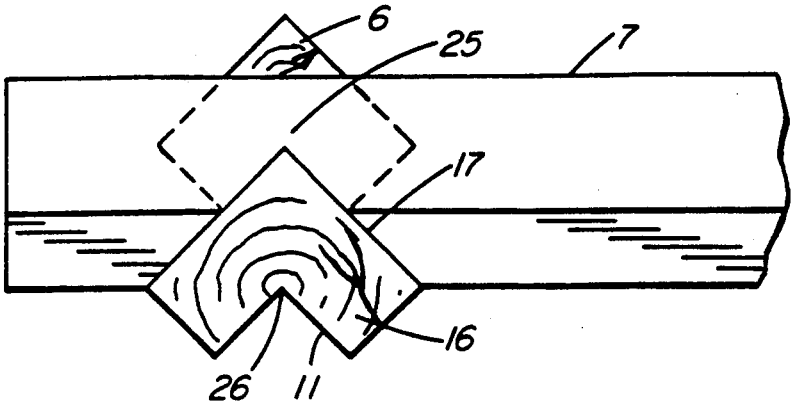

A penalty arises, however, from increasing the depth of the notch 17 excessively. As this notch 17 is deepened, less wood remains in the bridging portion 25 of the upper log 7. This wood provides support for the end 26 of the upper log 7. A convenient limit believed appropriate for the depth of the notch 17 is for this notch to penetrate into the log 7 no further than three quarters of the distance of diagonal of the log 7. This limit is shown in FIG. 5*b*, wherein the lower log 18, which was previously screening the face of the notch cut into the lower transverse log 16 has been omitted, and the transverse log 16 is sectioned at the plane of the corner.

This limit of penetration allows for the groove 11 to be of substantial width. This improves the weather-tightness and stability of the wall 2. However, increasing this width further will increase the consumption of logs 5 required to produce a wall of given height. A preferred criteria for the respective depths of the transverse notches and grooves is for the grooves to have a depth of between one eighth and one quarter of the diagonal of a standard squared log. This, in turn, places the depth of the transverse notches as equal to one half of that diagonal, plus one half of the depth of the groove.

Figure 6:
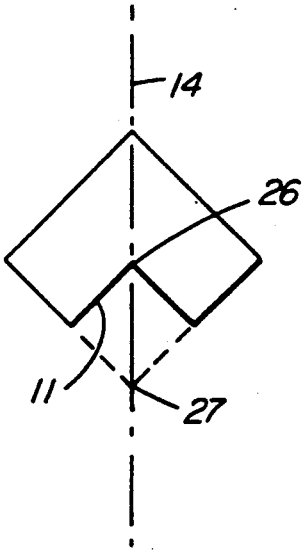
FIG. 6 is a diagramatic depiction of the end of a log, showing the definition of the measurement of the depth of the groove formed therein.

The "depth of the groove" referred to in this context is the length of the diagonal running from the apex 26 of the groove 11 to the lower corner 27 that would complete the log 6 is the groove were not formed. This is shown in FIG. 6. The full length of the diagonal running from the top edge 15 of the log to the lower corner 27 is equivalent to the "height" of each log before being grooved.

The preferred ratios given assume that a close fit is desired both along the groove of each log and at each notch. To prevent a gap from existing at the notches, the depth of the transverse "V"-shaped notch should not exceed one half of the length of the diagonal of the transverse log below, by more than one half of the depth of the longitudinal groove formed in the log being notched. A small gap between courses of logs may be desirable where such gap is to be filled with felt, or other compressible sealing material, in order to accommodate for slight misfitting between logs.

From the foregoing it will be seen that a means has been shown by which logs may be conveniently formed in a manner that will provide a weather-tight fit between courses, and a secure interengagement at corners.

The foregoing description has been of preferred embodiments which are intended to be exemplary of the invention. The invention in its broadest and more specific aspects is further described and defined in the claims which now follow.

I claim:

1. A structure having walls which intersect at corners, each of such walls lying within a respective, central vertical plane and being formed from horizontal courses of logs positioned in alignment with the vertical plane of their respective wall, each log having along the length of the log:

(1) an upper surface consisting of a pair of upper outwardly-directed, planar surfaces, to provide a longitudinal inverted "V" shaped upper edge to each log, and (2) a pair of inwardly-directed, lower, planar surfaces, substantially complementary in shape to said upper planar surfaces to provide a "V" shaped longitudinal groove along the lower length of each such log, the upper edge of each log being inter-fitted into the longitudinal groove of the next log above along successive courses of logs, each of said logs being provided with a transverse "V" shaped notch at the corners of said structure whereby intersecting courses of logs are nested with said transverse notch being complementary in shape to, and fitted over the upper surfaces of a transverse log from the intersecting wall.

2. A structure as in claim 1 wherein said upper and lower planar surfaces are symmetrically disposed about the respective central vertical plane of each wall.

3. A structure as in claim 2 wherein said logs are each provided with the same substantially square cross-section shape, interrupted by the longitudinal groove and transverse notches.

4. A structure as in claim 3 wherein the depth of the transverse notch in each log, does not exceed one half of the height of a log by more than one half of the depth of the longitudinal groove in each log, measured in the vertical plane.

5. A structure as in claim 4 wherein the depth of said transverse notch is equal to one-half of the height of a log, plus one half of the depth of the longitudinal groove in each log, measured in the vertical plane.

6. A structure as in claim 5 wherein the depth of said longitudinal groove does not exceed one exceed one half of the height of each log.

7. A structure as in claim 6 wherein the depth of the longitudinal groove is greater than one eighth, but less than one quarter of the height of each log.

* * * * *